United States Patent [19]

Montgomery

[11] 4,289,302

[45] Sep. 15, 1981

[54] FENCE ARRANGEMENT

[76] Inventor: J. L. Montgomery, 2565 Cherosen Rd., Louisville, Ky. 40205

[21] Appl. No.: 110,227

[22] Filed: Jan. 7, 1980

[51] Int. Cl.[3] ..... E04H 17/14

[52] U.S. Cl. ..... 256/19; 256/65

[58] Field of Search ..... 256/19, 65

[56] References Cited

U.S. PATENT DOCUMENTS

| | | | |
|---|---|---|---|
| 910,950 | 1/1909 | Noll | 256/19 |
| 931,616 | 8/1909 | Johanning | 256/19 |
| 948,834 | 2/1910 | Wagler | 256/19 |
| 983,367 | 2/1911 | Holmberg | 256/19 |
| 1,202,298 | 10/1916 | Loser | 256/19 |
| 1,653,308 | 12/1927 | Paltani | 256/19 |

FOREIGN PATENT DOCUMENTS

| | | | |
|---|---|---|---|
| 540165 | 4/1922 | France | 256/19 |

*Primary Examiner*—Andrew V. Kundrat

*Attorney, Agent, or Firm*—Edward M. Steutermann

[57] ABSTRACT

A precast fence arrangement and method for assembly thereof including first and second elongate fence post means of cast, hardened material including wire mesh reinforcement extending longitudinally along a portion of the length of the post and insert a selected distance from the surfaces of the post where the post means include spaced inset notch means of selected pheripheral configuration in selected faces of each post, elongate rail means of cast and hardened material with first and second opposite ends of pheripheral configuration adapted to be received in the notch means of adjacent post means where the fence is assembled by setting a first post means and inserting a first end of the rail means in the notch means of the first post means, inserting the second end of the rail means in cooperative notches of second post means and setting the second post means.

2 Claims, 10 Drawing Figures

FENCE ARRANGEMENT

BACKGROUND OF THE INVENTION

The present invention relates to a fence assembly utilizing prefabricated cast elements.

The prior art devices are known for the fabrication of similar devices. One such arrangement is shown in U.S. Pat. No. 2,955,806, Block which discloses a fence assembly including fence posts with elongate slots on each side where a multiplicity of bowed rails are stacked in edge of butting relation within the elongate slots.

It has been found that the prior art arrangements do not provide sufficient internal structural stability for the formation of notches in the posts to receive single rails and particularly that in cast devices adapted to provide rail receiving notches the corners of the posts tend to break when removed from the form or break away easily in service.

Moreover, prior art arrangements as shown in the Block reference and in Dillion, U.S. Pat. No. 2,057,018 generally provide an assembly method where adjacent cast posts are set and the rails are then inserted in the posts in stacked or other relationship to form a wall like structure. Moreover in such arrangements the rails are easily removed from the posts so the arrangement is less than permanent and is easily frustrated by would be intruders.

SUMMARY OF THE INVENTION

The present invention provides a new, useful, and economical method and apparatus for fabrication of permanent rail fences.

Arrangements within the scope of the present invention overcome the disadvantages of prior art in that the present invention provides an arrangement to permit formation of relatively small notches in a fence post in spaced relation along a selected face of the post to receive and support rail means in spaced parallel, generally horizontal relation.

Moreover, the present invention provides a method for assembly where the rails are securely retained in the posts so they cannot be easily removed and fences assembled in accordance with the method of the present invention are particularly useful in farm fencing application for retaining cattle or other animals where easy removal of the rails at remote locations is not desirable.

Moreover the method of the present invention provides an economical and attractive fence where the fence is virtually maintainence free.

More particularly, the pesent invention provides a precast fence arrangement and method for assembly thereof including first and second elongate fence post means of cast, hardened, materials including wire mesh reinforcement extending longitudinally along a portion of the length thereof where the post means includes spaced notch means of selected pheripheral configuration in aligned relation in each post, elongate rail means of cast, hardened material with first and second opposite ends of peripheral configuration adapted to be received in the notch means of adjacent post means where the fence is assembled by setting the first post means, inserting a first end of the rail means in the notch means of the first post means, inserting the second end of the rail means in the notches of the second post means and setting the second post means.

One example in accordance with the present invention is shown in the accompanying drawings described hereinafter and it will be recognized that various other arrangements within the scope of the present invention will occur to those skilled in the art upon reading the disclosure.

BRIEF DESCRIPTION OF THE DRAWINGS

Referring now to the accompanying drawings.

Figure 1:
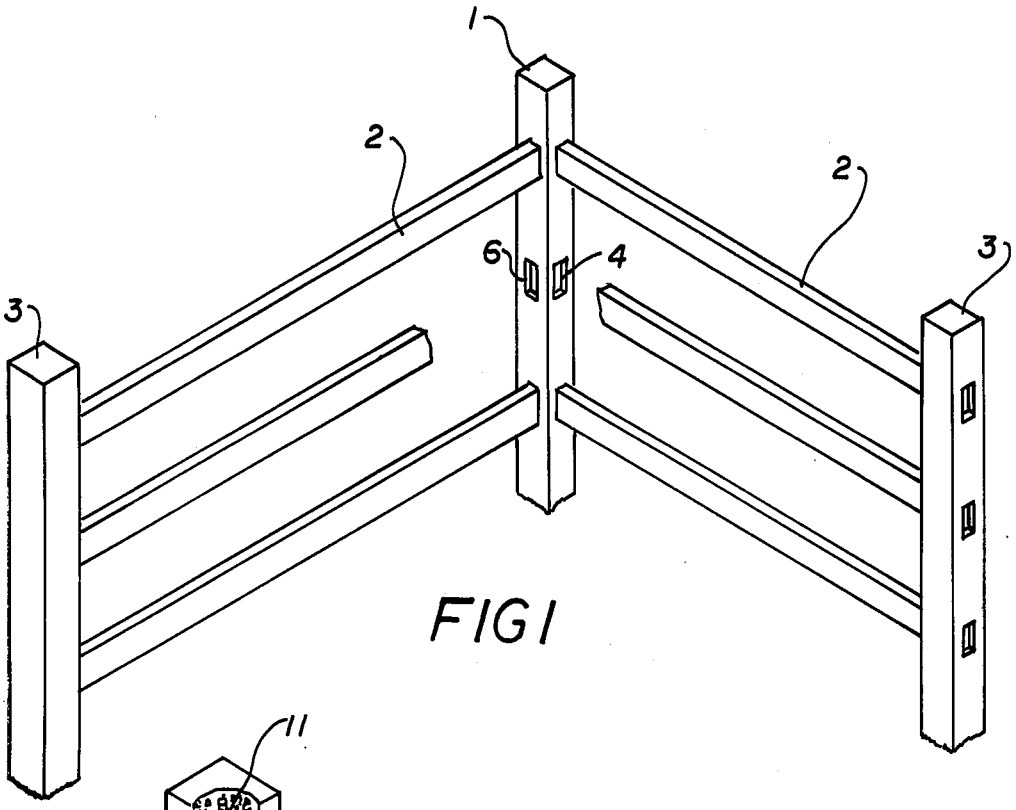
FIG. 1 is a perspective view of an assembled fence within the scope of the present invention.

Referring first to FIG. 1, a fence is illustrated in partially fabricated state and includes a corner post 1 with rails 2 extending outwardly therefrom to linepost 3. As shown and described hereinafter, post 1 has an apperture or slots 4 in one face to receive rail 2 where slots 6 are provided in the face at right angles to the first face to receive other rails 2. Line posts 3 are provided with cooperative slots 7 in opposite faces to receive rails 2, as shown.

Figure 2:
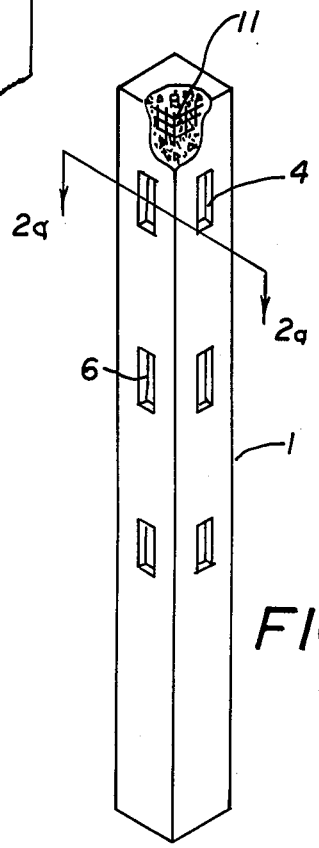
FIG. 2 is a view partially in section of a line post within the scope of the present invention.
Figure 2A:
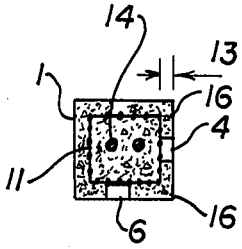
FIG. 2*a* is a cross sectional view taken along a plane passing through line 2—2 of FIG. 2.

FIG. 2 is a view partially in section of a corner post showing the reinforcing method utilized in the present invention. As shown in FIGS. 2 and 2*a*, the post is cast with an enclosed mesh reinforcing web 11 which can, for example, be of steel. In the arrangement shown web 11 is of generally square cross-section to provide reinforcement to all faces of the post. To form the post, according to one method, web 11 can be placed in centrally located position in a selected mold, where the mold includes forms to define slots 2 and 6 and where the slots can extend inwardly a distance illustrated by arrow 13 of FIG. 2*a* so the slot exposes web 11, as shown in FIG. 2. Within the scope of the present invention the depth of slots 4 or 6 can be selected so that web 11 is not exposed. The concrete or other suitable material is then placed in the mold to form the post with web 11 enclosed. Web 11 can extend a selected distance along post and as previously discussed it has been found that the use of reinforcing web 11 prevent pullout or breaking of section 16 between the edges of slots 12 and the corner of the post. Where desired, and particularly where the web 11 does not extend the full length of the post, additional reinforcing means, for example steel bars 14 can be provided to lend additional strength to the post.

Figure 3:
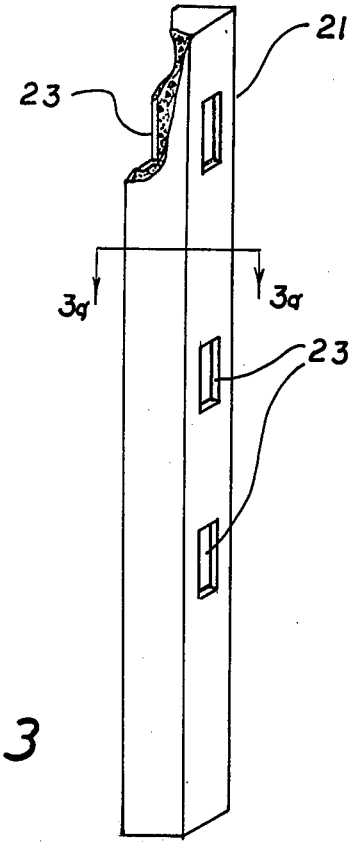
FIG. 3 is a view partially in section of one corner post within the scope of the present invention.
Figure 3A:
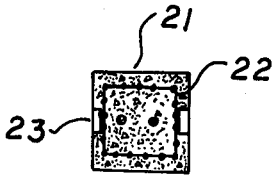
FIG. 3*a* is a view taken along a plane passing through line 3—3 of FIG. 3.

Likewise as shown in FIG. 3 and in FIG. 3*a* line posts 21 are formed to include web means 22 where slots 23 are provided but in the case of line posts the slots are provided in opposite faces of the posts.

FIG. 3*a* is an illustration in cross section showing the arrangement of the elements.

Figure 4A:
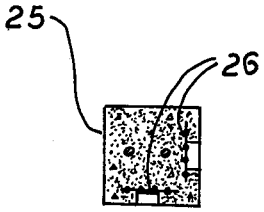
FIG. 4*a* is a view taken along a plane passing through line 4—4 of FIG. 4.
Figure 4:
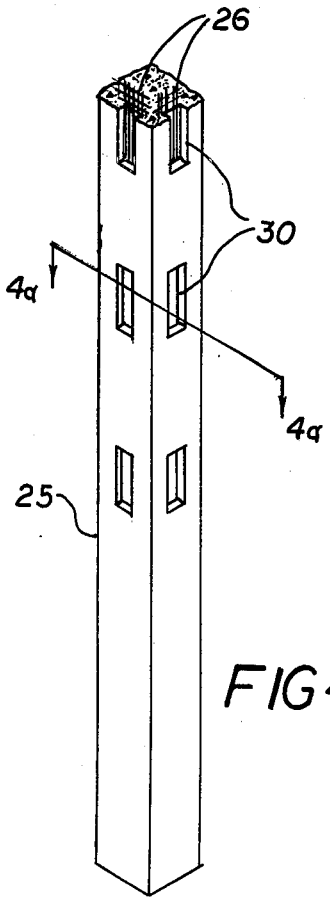
FIG. 4 is a view partially in section of another arrangement of a line post within the scope of the present invention.

FIG. 4 is another arrangement within the scope of the present invention where two sheets of web 26 are provided in the post 25 and inset from the face in which the slots 30 are formed as shown in FIG. 4*a*. In the arrangement shown in FIG. 4 the sheets of webbing are used in place of the square form shown in FIG. 3. While the arrangements shown in FIGS. 2 and 3 provide additional strength the arrangement in FIG. 4 is satisfactory.

Within the scope of the present invention other arrangements of web can be provided in the posts in the area of the notch. In any such case it has been found that the use of web reinforcement provides unexpected strength to the corners of the post in the areas of the notch to prevent breaking of the corners when the post is withdrawn from the mold and the form is removed from the notch. Additionally, the methods and arrangements within the scope of the present invention provide additional strength to the post to prevent breakout of the rail in use.

Figure 5:
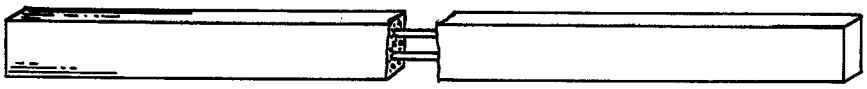
FIG. 5 is a view partially in section of a rail within the scope of the present invention.

FIG. 5 is an illustration of a prefabricated rail 30 which can include reinforcing bars 31 where opposite ends 32, 33 of the rail are of selected peripherial configuration to be received by the notches 2, 3 or 4. Rails 40 can be formed, as known in the art from concrete or other suitable material with bars 31 suspended in the mold. Where desired, the bars can be placed in tension prior to forming the concrete to provide a prestressed bar of superior structural qualities.

The elements, that is the corner posts, line posts and rails can be prefabricated and moved to the installation site for assembly. One method for assembly within the scope of the present invention is illustrated in FIGS. 6*a* and 6*b*.

Figure 6A:
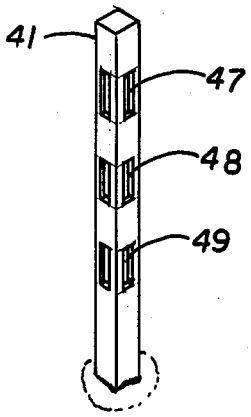
FIGS. 6*a* and 6*b* are perspective illustrations of the method of assembly of fences within the scope of the present invention.
Figure 6B:
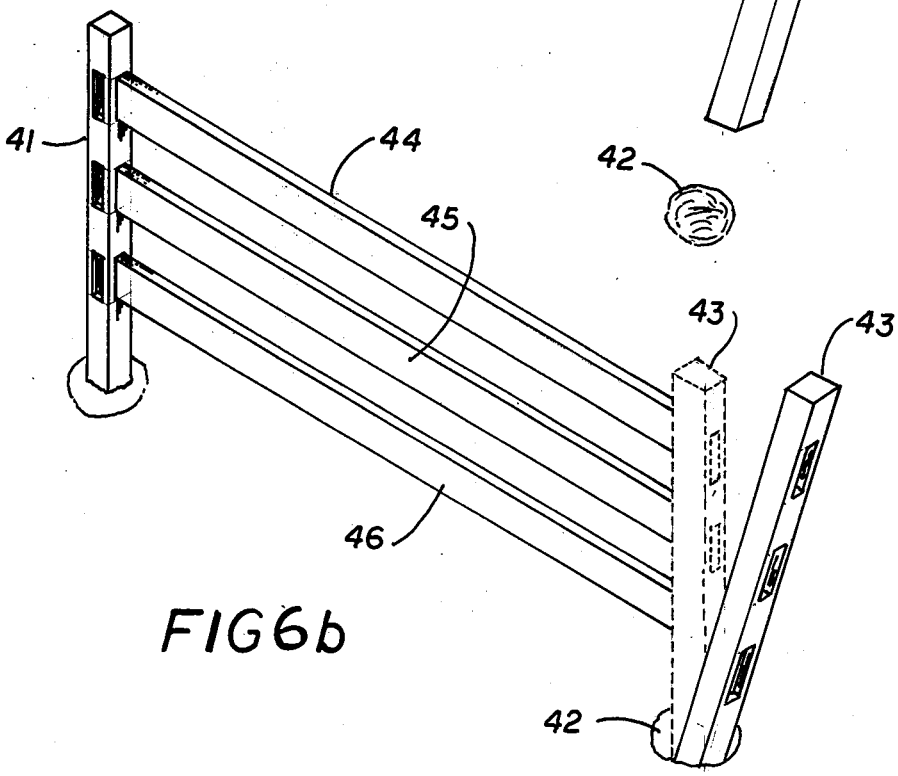

As shown in FIG. 6*a*, a corner post 41 can be set and the hole 42 dug for an adjoining line post 43. As shown in FIG. 6*b*, rails 44, 45 and 46 are placed in notches 47, 48 and 49 of post 41 and post 43 is then set with the rails 44, 45 and 46 received in cooperative notches of post 43. Within the scope of the present invention, an adhesive, for example epoxy cement, can be applied to the ends of nails 44 and 46 and/or the associated notches prior to assembly.

It will be recognized that the foregoing are but a few examples of arrangements within the scope of the present invention and that various other arrangements, also within the scope of the present invention, will occur to those skilled in the art upon reading the foregoing disclosure.

I claim:

1. A precast fence arrangement including first and second elongate post means of cast, hardened material having a multiplicity of faces including wire mesh reinforcement within said post and inset a selected inset distance from the selected closest faces of the post and extending longitudinally along a portion of the length of the posts where the post means include at least one pair of inset blind notch means of selected peripheral configuration each in aligned relation with respect to a traverse plane through said post and each in a different one of said selected faces thereof where the depth of said notches is less than the corresponding selected inset distance; and elongate rail of cast, hardened material with first and second opposite ends of pheripheral configuration adapted to be received in the notch means of adjacent post means.

2. A method for assembly of a fence arrangement including first and second elongate post means of cast hardened material with wire mesh reinforcement within said post means and inset a selected inset distance from the closest selected face of said post where the posts include spaced blind notch means of selected pheripheral configuration in said selected faces thereof with a depth less than said inset distance where the first and second post are placed in one end of each post in the ground and spaced in aligned relation with the notches of each post facing each other and elongate rail means of cast, hardened material with first and second opposite ends of pheripheral configuration adapted to be received in the notch means of adjacent post means where the fence is assembled by setting the first post means, inserting a first end of the rail means in the notch means of the first post means, inserting the second end of the rail means in the notch means of the second post means and setting the second post means.

* * * * *